US010847168B2

(12) United States Patent
Neuhauser et al.

(10) Patent No.: US 10,847,168 B2
(45) Date of Patent: Nov. 24, 2020

(54) RESEARCH DATA GATHERING

(71) Applicant: The Nielsen Company (US), LLC, New York, NY (US)

(72) Inventors: Alan R. Neuhauser, Silver Spring, MD (US); Jack C. Crystal, Owings Mills, MD (US)

(73) Assignee: The Nielsen Company (US), LLC, New York, NY (US)

( * ) Notice: Subject to any disclaimer, the term of this patent is extended or adjusted under 35 U.S.C. 154(b) by 0 days.

(21) Appl. No.: 16/572,143

(22) Filed: Sep. 16, 2019

(65) Prior Publication Data

US 2020/0013418 A1 Jan. 9, 2020

Related U.S. Application Data

(63) Continuation of application No. 15/799,620, filed on Oct. 31, 2017, now Pat. No. 10,418,039, which is a continuation of application No. 14/236,848, filed as application No. PCT/US2008/001017 on Jan. 25, 2008, now Pat. No. 9,824,693.

(60) Provisional application No. 60/897,349, filed on Jan. 25, 2007, provisional application No. 60/886,615, filed on Jan. 25, 2007.

(51) Int. Cl.
*G10L 19/018* (2013.01)
*G10L 25/78* (2013.01)

(52) U.S. Cl.
CPC ..... *G10L 19/018* (2013.01); *G10L 25/78* (2013.01)

(58) Field of Classification Search
CPC ..... G10L 19/018
See application file for complete search history.

(56) References Cited

U.S. PATENT DOCUMENTS 5,612,729 A * 3/1997 Ellis ..... G06K 9/00711 725/22
5,764,763 A * 6/1998 Jensen ..... H04H 20/31 380/253

(Continued)

FOREIGN PATENT DOCUMENTS

WO 0022605 4/2000
WO 03003628 1/2003

OTHER PUBLICATIONS

International Searching Authority, "Written Opinion," mailed in connection with International Patent Application No. PCT/US08/01017, dated May 20, 2008, 7 pages.

(Continued)

*Primary Examiner* — Douglas Godbold
(74) *Attorney, Agent, or Firm* — Hanley, Flight & Zimmerman, LLC

(57) ABSTRACT

Methods, apparatus and articles of manufacture for research data gathering are disclosed. An example apparatus disclosed herein is to detect whether the apparatus is powered by an internal power source or an external power source. The example apparatus is also to, in response to detecting the apparatus is powered by the internal power source, perform first processing on a received audio signal to determine audio data to store in storage of the apparatus. The example apparatus is further to, in response to detecting the apparatus is powered by the external power source, perform second processing on the stored audio data to recover the code, the second processing different from the first processing.

20 Claims, 12 Drawing Sheets

(56) References Cited

U.S. PATENT DOCUMENTS

| | | | | |
|---|---|---|---|---|
| 6,338,037 | B1 | 1/2002 | Todd et al. | |
| 6,427,012 | B1 | 7/2002 | Petrovic | |
| 6,504,870 | B2 | 1/2003 | Srinivasan | |
| 7,031,921 | B2 | 4/2006 | Pitman et al. | |
| 7,131,007 | B1 | 10/2006 | Johnston et al. | |
| 7,146,503 | B1 * | 12/2006 | Johnston | G10L 19/018 713/176 |
| 2003/0030465 | A1 * | 2/2003 | Robins | G08B 13/19636 307/85 |
| 2003/0076438 | A1 * | 4/2003 | Ishimaru | H04N 5/232 348/372 |
| 2004/0059918 | A1 * | 3/2004 | Xu | G10L 19/018 713/176 |
| 2004/0064319 | A1 * | 4/2004 | Neuhauser | G10L 19/018 704/273 |
| 2004/0102961 | A1 * | 5/2004 | Jensen | H04H 20/31 704/201 |
| 2004/0113497 | A1 * | 6/2004 | May | H02J 1/08 307/86 |
| 2005/0177332 | A1 * | 8/2005 | Lemma | G10L 19/018 702/106 |
| 2005/0177361 | A1 | 8/2005 | Srinivasan | |
| 2005/0235168 | A1 * | 10/2005 | Nonaka | G11B 19/02 713/300 |
| 2006/0069524 | A1 * | 3/2006 | Hashimoto | F16H 61/12 702/116 |
| 2006/0212704 | A1 * | 9/2006 | Kirovski | G10L 19/018 713/176 |
| 2006/0239501 | A1 * | 10/2006 | Petrovic | G06T 1/0028 382/100 |
| 2006/0239503 | A1 * | 10/2006 | Petrovic | H04L 9/002 382/100 |
| 2007/0011558 | A1 * | 1/2007 | Wright | H04H 20/31 714/755 |
| 2018/0068668 | A1 | 3/2018 | Neuhauser et al. | |

OTHER PUBLICATIONS

International Searching Authority, "International Preliminary Report on Patentability," mailed in connection with International Patent Application No. PCT/US08/01017, dated Jul. 28, 2009, 8 pages.

IP Australia, "Patent Examination Report No. 1," mailed in connection with Australian Patent Application No. 2008209451, dated Nov. 15, 2012, 4 pages.

State Intellectual Property Office of the People's Republic of China, "First Office Action," mailed in connection with Chinese Patent Application No. 200880007456.3, dated Mar. 9, 2011, 10 pages.

State Intellectual Property Office of the People's Republic of China, "Second Office Action," mailed in connection with Chinese Patent Application No. 200880007456.3, dated Mar. 1, 2012, 7 pages.

Canadian Intellectual Property Office, "Office Action," mailed in connection with Canadian Patent Application No. 2,676,516, dated Jul. 25, 2016, 3 pages.

IP Australia, "Notice of Acceptance," mailed in connection with Australian Patent Application No. 2014227513, dated Aug. 15, 2016, 2 pages.

European Patent Office, "European Search Report," mailed in connection with European Patent Application No. 08724832.4, dated Jul. 20, 2015, 7 pages.

IP Australia, "Examination Report," mailed in connection with Australian Patent Application No. 2014227513, dated Feb. 15, 2016, 2 pages.

Canadian Intellectual Property Office, "Office Action," mailed in connection with Canadian Patent Application No. 2,676,516, dated Dec. 7, 2015, 3 pages.

Canadian Intellectual Property Office, "Office Action," mailed in connection with U.S. Appl. No. 2,676,516, dated Jun. 28, 2017, 4 pages.

International Searching Authority, "Search Report," mailed in connection with International Patent Application No. PCT/US08/01017, dated May 20, 2008, 1 page.

IP Australia, "Notice of Acceptance," mailed in connection with Australian Patent Application No. 2008209451, dated Jun. 5, 2014, 2 pages.

Canadian Intellectual Property Office, "Office Action," mailed in connection with Canadian Patent Application No. 2,676,516, dated Sep. 29, 2014, 3 pages.

United States Patent and Trademark Office, "Non-Final Office Action," mailed in connection with U.S. Appl. No. 14/236,848, dated Apr. 27, 2016, 13 pages.

United States Patent and Trademark Office, "Final Office Action," mailed in connection with U.S. Appl. No. 14/236,848, dated Oct. 14, 2016, 14 pages.

United States Patent and Trademark Office, "Non-Final Office Action," mailed in connection with U.S. Appl. No. 14/236,848, dated Feb. 27, 2017, 19 pages.

United States Patent and Trademark Office, "Notice of Allowance," mailed in connection with U.S. Appl. No. 14/236,848, dated Jul. 20, 2017, 11 pages.

Canadian Intellectual Property Office, "Office Action," mailed in connection with Canadian Patent Application No. 2,676,516, dated Jun. 26, 2018, 3 pages.

United States Patent and Trademark Office, "Notice of Allowance," mailed in connection with U.S. Appl. No. 15/799,620, dated May 8, 2019, 9 pages.

United States Patent and Trademark Office, "Non-final Office Action," mailed in connection with U.S. Appl. No. 15/799,620, dated Jan. 14, 2019, 18 pages.

European Patent Office, "Communication under Rule 71(3) EPC," mailed in connection with European Patent Application No. 08724832.4, dated Jan. 3, 2020, 54 pages.

European Patent Office, "Extended European Search Report," mailed in connection with European Patent Application No. 20179179.5, dated Aug. 27, 2020, 7 pages.

* cited by examiner

| FFT BINS | FREQ. |
|---|---|
| 263 | 1027 |
| 316 | 1234 |
| 356 | 1391 |
| 416 | 1625 |
| 461 | 1801 |
| 504 | 1969 |
| 553 | 2160 |
| 623 | 2434 |
| 665 | 2598 |
| 726 | 2836 |

FIG. 8

| FFT BINS | FREQ. |
|---|---|
| 264 | 1029 |
| 317 | 1237 |
| 357 | 1393 |
| 417 | 1628 |
| 462 | 1804 |
| 505 | 1973 |
| 554 | 2164 |
| 624 | 2438 |
| 666 | 2603 |
| 727 | 2842 |

FIG. 9

RESEARCH DATA GATHERING

RELATED APPLICATION(S)

This patent arises from a continuation of U.S. patent application Ser. No. 15/799,620 (now U.S. Pat. No. 10,418,039), entitled "RESEARCH DATA GATHERING," which was filed on Oct. 31, 2017, which is a continuation of U.S. patent application Ser. No. 14/236,848 (now U.S. Pat. No. 9,824,693), entitled "RESEARCH DATA GATHERING," which was filed on Feb. 3, 2014, which corresponds to the U.S. national stage of International Patent Application Serial No. PCT/US08/01017, entitled "RESEARCH DATA GATHERING," which was filed on Jan. 25, 2008, which claims the benefit of and priority from U.S. Provisional Patent Application Ser. No. 60/886,615, entitled "RESEARCH DATA GATHERING WITH MULTI-MODE AND/OR MULTI-PROCESSING," which was filed on Jan. 25, 2007, and U.S. Provisional Application Ser. No. 60/897,349, entitled "RESEARCH DATA GATHERING WITH MULTI-MODE AND/OR MULTI-PROCESSING," which was filed on Jan. 25, 2007. Priority to U.S. patent application Ser. No. 15/799,620, U.S. patent application Ser. No. 14/236,848, International Patent Application Serial No. PCT/US08/01017, U.S. Provisional Patent Application Ser. No. 60/886,615 and U.S. Provisional Application Ser. No. 60/897,349 is claimed. U.S. patent application Ser. No. 15/799,620, U.S. patent application Ser. No. 14/236,848, International Patent Application Serial No. PCT/US08/01017, U.S. Provisional Patent Application Ser. No. 60/886,615 and U.S. Provisional Application Ser. No. 60/897,349 are hereby incorporated by reference in their respective entireties.

FIELD OF THE DISCLOSURE

The present invention relates to data acquisition and more particularly to environmental data acquisition.

BACKGROUND

There is considerable interest in encoding audio as well as video signals for various applications. For example, in order to identify what an individual or an audience is listening to at a particular time, a listener's environment is monitored for audio signals at regular intervals. If the audio signals contain an identification code, those audio signals may be identified by reading such a code.

It is known to encode an identification code in conjunction with a broadcast signal. For example, it is known to encode both a payload signal and an ancillary signal into an audio signal, where the ancillary signal includes an identification code. By detecting and decoding the ancillary code, and associating the detected code with one or more individuals, it is possible to correlate media audience activity to the delivery of a particular payload signal.

SUMMARY

Having examined and understood a range of previously available devices, the inventors of the present invention have developed a new and important understanding of the problems associated with the prior art and, out of this novel understanding, have developed new and useful solutions and improved devices, including solutions and devices yielding surprising and beneficial results not previously discovered or disclosed by creative practitioners of ordinary skill in the art.

The invention encompassing these new and useful solutions and improved devices is described below in its various aspects with reference to several exemplary embodiments including a preferred embodiment.

Identifying audio signals heard by listeners is useful and often important to various groups. Copyright owners seeking to facilitate copyright enforcement and protection form such a group. Copyrighted works may be encoded with watermarks or other types of identification information to enable electronic devices to ascertain when those copyrighted works are reproduced or copied or, alternatively, to restrict such reproduction or copying.

Another potentially interested group are audio listeners, many of whom seek to obtain additional information about the received audio, including information that identifies the audio work, such as the name of the work, its performer, the identity of the broadcaster, and so on.

Still another group interested in ascertaining what listeners and viewers perceive and/or are exposed to, whether through audible and/or visual messages, program content, advertisements, etc., are market research companies and their clients, including advertisers, advertising agencies and media outlets. Market research companies typically engage in audience measurement or perform other operations (e.g., implement customer loyalty programs, commercial verification, etc.) using various techniques.

Yet still another interested group are those seeking additional bandwidth to communicate data for other purposes that may or may not be unrelated to the audio and/or video signal (e.g., song, program) itself. For example, telecommunications companies, news organizations and other entities could utilize the additional bandwidth to communicate data for various reasons, such as the communication of news, financial information, etc.

In view of the foregoing, it is greatly desired to be able to detect accurately identification codes encoded within audio and/or video signals. However, many factors can interfere with the detection process, especially where encoded audio is communicated via an acoustic channel. Acoustic characteristics of audio environments vary greatly and, hence, rates of accurate detection differ depending on such environments. For example, various environments are quite hostile to easy and accurate detection of encoded identification codes whether in audio or video due to the existence of excessive noise or interference. In some instances and for various reasons, data encoded within audio and/or video signals are not properly transmitted by the electronic equipment transmitting such signals, and/or the electronic equipment receiving the audio and/or video signals, for one reason or another, do not properly receive the encoded data.

Therefore, there is great demand for a system/process that is capable of ascertaining with sufficient accuracy ancillary codes encoded within audio and/or video signals during real-world, imperfect conditions, These and other advantages and features of the invention will be more readily understood in relation to the following detailed description of the invention, which is provided in conjunction with the accompanying drawings.

BRIEF DESCRIPTION OF THE DRAWINGS

FIG. 8 shows a table identifying ten exemplary frequency bins and their corresponding frequency components in which code components are expected to be included in audio media data containing an ancillary code;

FIG. 9 shows a table identifying exemplary frequency bins and their corresponding frequency components in which code components expected to be included in audio media data containing an ancillary code are offset;

DETAILED DESCRIPTION

Figure 1:
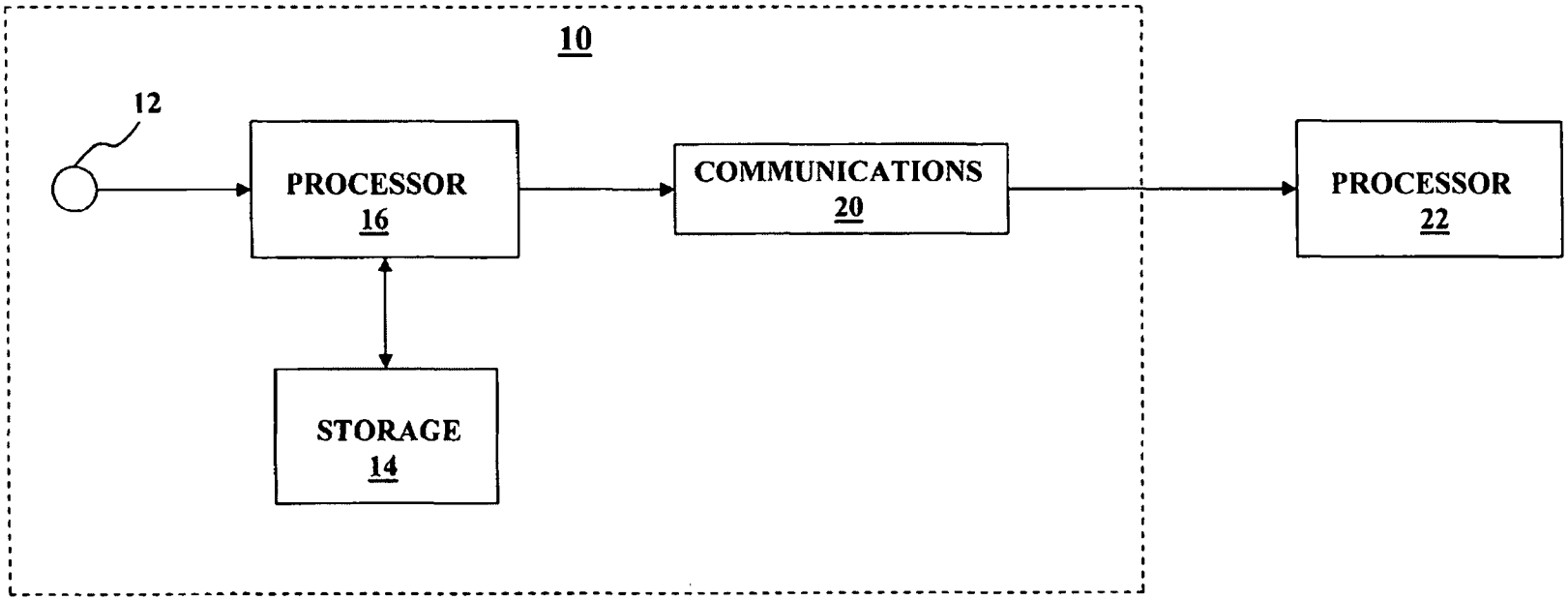
FIG. 1 is a functional block diagram illustrating certain embodiments of a system for reading ancillary codes encoded in audio media data.

The following description is provided to enable any person skilled in the art to make and use the disclosed inventions and sets forth the best modes presently contemplated by the inventors of carrying out their inventions. In the following description, for purposes of explanation, numerous specific details are set forth in order to provide a thorough understanding of the present invention. It will be apparent, however, to one skilled in the art that the present invention may be practiced without these specific details. In other instances, well-known structures and devices are shown in block diagram form in order to avoid unnecessarily obscuring the present inventions.

For this application the following terms and definitions shall apply:

The term "data" as used herein means any indicia, signals, marks, symbols, domains, symbol sets, representations, and any other physical form or forms representing information, whether permanent or temporary, whether visible, audible, acoustic, electric, magnetic, electromagnetic or otherwise manifested. The term "data" as used to represent predetermined information in one physical form shall be deemed to encompass any and all representations of corresponding information in a different physical form or forms.

The terms "media data" and "media" as used herein mean data which is widely accessible, whether over-the-air, or via cable, satellite, network, internetwork (including the Internet), print, displayed, distributed on storage media, or by any other means or technique that is humanly perceptible, without regard to the form or content of such data, and including but not limited to audio, video, audio/video, text, images, animations, databases, broadcasts, displays (including but not limited to video displays, posters and billboards), signs, signals, web pages, print media and streaming media data.

The term "research data" as used herein means data comprising (1) data concerning usage of media data, (2) data concerning exposure to media data, and/or (3) market research data.

The term "ancillary code" as used herein means data encoded in, added to, combined with or embedded in media data to provide information identifying, describing and/or characterizing the media data, and/or other information useful as research data.

The term "reading" as used herein means a process or processes that serve to recover research data that has been added to, encoded in, combined with or embedded in, media data.

The term "database" as used herein means an organized body of related data, regardless of the manner in which the data or the organized body thereof is represented. For example, the organized body of related data may be in the form of one or more of a table, a map, a grid, a packet, a datagram, a frame, a file, an e-mail, a message, a document, a list or in any other form.

The term "network" as used herein includes both networks and internetworks of all kinds, including the Internet, and is not limited to any particular network or inter-network.

The terms "first", "second", "primary" and "secondary" are used to distinguish one element, set, data, object, step, process, activity or thing from another, and are not used to designate relative position or arrangement in time, unless otherwise stated explicitly.

The terms "coupled", "coupled to", and "coupled with" as used herein each mean a relationship between or among two or more devices, apparatus, files, circuits, elements, functions, operations, processes, programs, media, components, networks, systems, subsystems, and/or means, constituting any one or more of (a) a connection, whether direct or through one or more other devices, apparatus, files, circuits, elements, functions, operations, processes, programs, media, components, networks, systems, subsystems, or means, (b) a communications relationship, whether direct or through one or more other devices, apparatus, files, circuits, elements, functions, operations, processes, programs, media, components, networks, systems, subsystems, or means, and/or (c) a functional relationship in which the operation of any one or more devices, apparatus, files, circuits, elements, functions, operations, processes, programs, media, components, networks, systems, subsystems, or means depends, in whole or in part, on the operation of any one or more others thereof.

The terms "communicate," "communicating" and "communication" as used herein include both conveying data from a source to a destination, and delivering data to a communications medium, system, channel, network, device, wire, cable, fiber, circuit and/or link to be conveyed to a destination. The term "communications" as used herein includes one or more of a communications medium, system, channel, network, device, wire, cable, fiber, circuit and link.

The term "processor" as used herein means processing devices, apparatus, programs, circuits, components, systems and subsystems, whether implemented in hardware, software or both, and whether or not programmable. The term "processor" as used herein includes, but is not limited to one or more computers, hardwired circuits, signal modifying devices and systems, devices and machines for controlling systems, central processing units, programmable devices and systems, field programmable gate arrays, application specific integrated circuits, systems on a chip, systems comprised of discrete elements and/or circuits, state machines, virtual machines, data processors, processing facilities and combinations of any of the foregoing.

The terms "storage" and "data storage" as used herein mean one or more data storage devices, apparatus, programs, circuits, components, systems, subsystems, locations and storage media serving to retain data, whether on a temporary or permanent basis, and to provide such retained data.

The terms "panelist," "respondent" and "participant" are interchangeably used herein to refer to a person who is, knowingly or unknowingly, participating in a study to gather information, whether by electronic, survey or other means, about that person's activity.

The term "research device" as used herein shall mean (1) a portable user appliance configured or otherwise enabled to gather, store and/or communicate research data, or to cooperate with other devices to gather, store and/or communicate research data, and/or (2) a research data gathering, storing and/or communicating device.

FIG. 1 is a functional block diagram illustrating advantageous embodiments of a system 10 for reading ancillary codes encoded as messages in audio media data. In certain ones of such embodiments, the encoded messages comprise a continuing stream of messages including data useful in audience measurement, commercial verification, royalty calculations and the like. Such data typically includes an identification of a program, commercial, file, song, network, station or channel, or otherwise describes some aspect of the media audio data or other data related thereto, so that it characterizes the audio media data. In certain ones of such embodiments, the continuing stream of encoded messages is comprised of symbols arranged time-sequentially in the audio media data.

The system 10 comprises an audio media data input 12 for receiving audio media data that may be encoded with ancillary codes. In certain embodiments, the audio media data input 12 comprises or is included in, either a single device, stationary at a source to be monitored, or multiple devices, stationary at multiple sources to be monitored. In certain embodiments, the audio media data input 12 comprises and/or is included in, a portable monitoring device that can be carried by an individual to monitor whatever audio media data the individual is exposed to. In certain embodiments, a PUA comprises the audio media data input.

Where the audio media data is acoustic data, the audio media data input 12 typically would comprise an acoustic transducer, such as a microphone, having an input which receives audio media data in the form of acoustic energy and which serves to transduce the acoustic energy to electrical data. Where audio media data in the form of light energy is monitored, the audio media data input 12 comprises a light-sensitive device, such as a photodiode. In certain embodiments, the audio media data input 12 comprises a magnetic pickup for sensing magnetic fields associated with a speaker, a capacitive pickup for sensing electric fields or an antenna for electromagnetic energy. In still other embodiments, the audio media data input 12 comprises an electrical connection to a monitored device, which may be a television, a radio, a cable converter, a satellite television system, a game playing system, a VCR, a DVD player, a PUA, a portable media player, a hi-fi system, a home theater system, an audio reproduction system, a video reproduction system, a computer, a web appliance, or the like. In still further embodiments, the audio media data input 12 is embodied in monitoring software running on a computer or other reproduction or processing system to gather media data.

Storage 14 stores the received audio media data for subsequent processing. Processor 16 serves to process the received data to read ancillary codes encoded in the audio media data and stores the detected encoded messages in storage 14. For example, it may be desired to store the data produced by processor 16 for later use. Communications 20 coupled with processor 16 serves to communicate data from system 10, for example, to a further processor 22. In certain embodiments, further processor 22 produces reports based on ancillary codes read by processor 16 from audio media data and communicated from system 10. In certain embodiments, processor 22 processes audio media data communicated from system 10 either in compressed or uncompressed form, to read ancillary codes therein. In certain embodiments, processor 16 carries out preliminary processing of the audio media data to reduce the processing demands on the processor 22 which completes processing of the preprocessed data to read ancillary codes therefrom. In certain embodiments, processor 16 serves to read ancillary codes in audio media data using a first process and processor 22 further processes the ancillary codes and/or the audio media data gathered by system 10 using a second process that is a modified version of the first process or a different process.

A method of gathering data concerning usage of and/or exposure to media data comprises processing the media data using a parameter having a first value to produce first media usage of and/or exposure data, assigning a second value to the parameter, the second value being different from the first value, and processing the media data using the parameter having the second value to produce second media usage of and/or exposure data.

A system for gathering data concerning usage of and/or exposure to media data comprises a processor configured to process the media data using a parameter having a first value to produce first media usage and/or exposure data, to assign a second value to the parameter, the second value being different from the first value, and to process the media data using the parameter having the second value to produce second media usage and/or usage of and/or exposure data.

Figure 2:
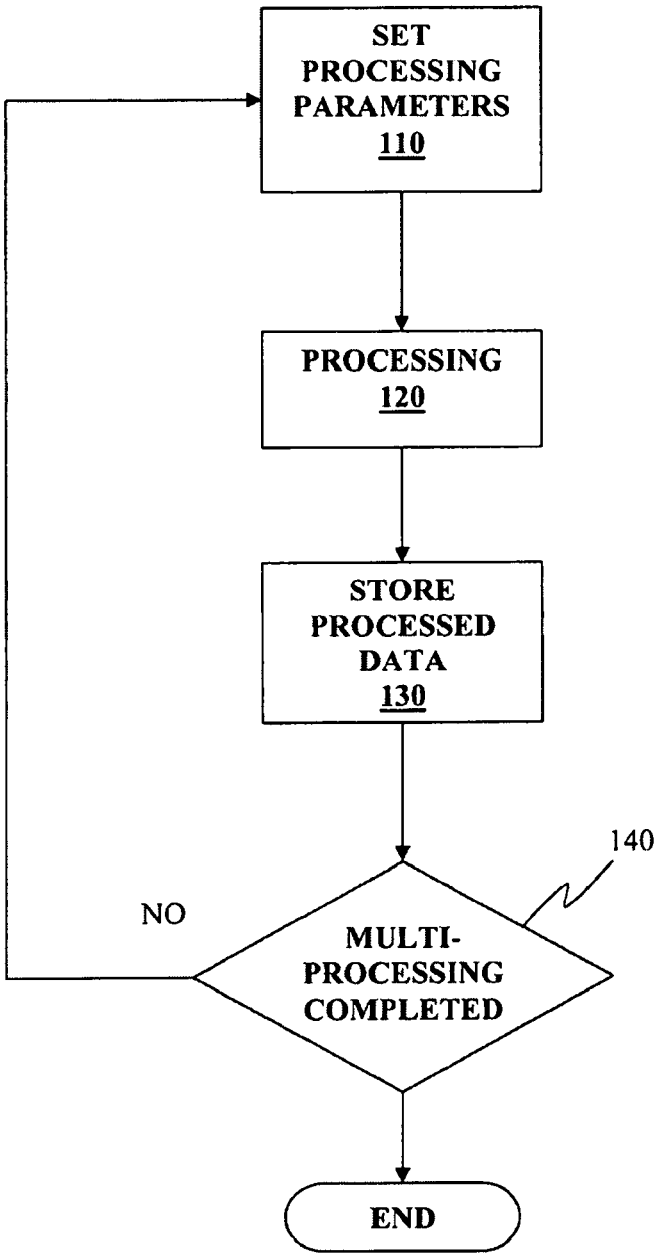
FIG. 2 illustrates an ancillary code reading process of various embodiments including the embodiments illustrated in FIG. 1.

FIG. 2 is a flow diagram 100 provided for use in illustrating the decoding processes carried out by processor 16 as well as in other embodiments. Initially, parameters used to process the received media data are set 110. Various parameters that may be set, and as further described below, include window size and frequency scale. In particular, the type of parameter or parameters that are set 110 depends on the type of processing carried out 120 by processor 16 on the received media data. In certain embodiments, processor 16 carries out a symbol sequence evaluation of the audio media data to read symbols of encoded messages included in the audio media data as a continuing stream of encoded messages. Various code reading techniques suitable for processing 120 are disclosed in U.S. Pat. No. 5,764,763 to Jensen et at., U.S. Pat. No. 5,450,490 to Jensen et at., U.S. Pat. No. 5,579,124 to Aijala et at., U.S. Pat. No. 5,581,800 to Fardeau et at., U.S. Pat. No. 6,871,180 to Neuhauser, et at., U.S. Pat. No. 6,845,360 to Jensen, et at., U.S. Pat. No. 6,862,355 to Kolessar, et at., U.S. Pat. No. 5,319,735 to Preuss et at., U.S. Pat. No. 5,687,191 to Lee, et al., U.S. Pat. No. 6,175,627 to Petrovich et at., U.S. Pat. No. 5,828,325 to Wolosewicz et al., U.S. Pat. No. 6,154,484 to Lee et at., U.S. Pat. No. 5,945,932 to Smith et at., US 2001/0053190 to Srinivasan, US 2003/0110485 to Lu, et at., U.S. Pat. No. 5,737,025 to Dougherty, et al., US 2004/0170381 to Srinivasan, and WO 06/14362 to Srinivasan, et at., all of which hereby are incorporated by reference herein.

Examples of techniques for encoding ancillary codes in audio, and for reading such codes, are provided in Bender, et al., "Techniques for Data Hiding", IBM Systems Journal, Vol. 35, Nos. 3 & 4, 1996, which is incorporated herein in its entirety. Bender, et at. disclose a technique for encoding audio termed "phase encoding" in which segments of the audio are transformed to the frequency domain, for example, by a discrete Fourier transform (DFT), so that phase data is produced for each segment. Then the phase data is modified to encode a code symbol, such as one bit. Processing of the phase encoded audio to read the code is carried out by synchronizing with the data sequence, and detecting the phase encoded data using the known values of the segment length, the DFT points and the data interval.

Bender, et al. also describe spread spectrum encoding and decoding, of which multiple embodiments are disclosed in the above-cited Aijala, et at. U.S. Pat. No. 5,579,124.

Still another audio encoding and decoding technique described by Bender, et at. is echo data hiding in which data is embedded in a host audio signal by introducing an echo. Symbol states are represented by the values of the echo delays, and they are read by any appropriate processing that serves to evaluate the lengths and/or presence of the encoded delays.

A further technique, or category of techniques, termed "amplitude modulation" is described in R. Walker, "Audio Watermarking", BBC Research and Development, 2004. In this category fall techniques that modify the envelope of the audio signal, for example by notching or otherwise modifying brief portions of the signal, or by subjecting the envelope to longer term modifications. Processing the audio to read the code can be achieved by detecting the transitions representing a notch or other modifications, or by accumulation or integration over a time period comparable to the duration of an encoded symbol, or by another suitable technique.

Another category of techniques identified by Walker involves transforming the audio from the time domain to some transform domain, such as a frequency domain, and then encoding by adding data or otherwise modifying the transformed audio. The domain transformation can be carried out by a Fourier, DCT, Hadamard, Wavelet or other transformation, or by digital or analog filtering. Encoding can be achieved by adding a modulated carrier or other data (such as noise, noise-like data or other symbols in the transform domain) or by modifying the transformed audio, such as by notching or altering one or more frequency bands, bins or combinations of bins, or by combining these methods. Still other related techniques modify the frequency distribution of the audio data in the transform domain to encode. Psychoacoustic masking can be employed to render the codes inaudible or to reduce their prominence. Processing to read ancillary codes in audio data encoded by techniques within this category typically involves transforming the encoded audio to the transform domain and detecting the additions or other modifications representing the codes.

A still further category of techniques identified by Walker involves modifying audio data encoded for compression (whether lossy or lossless) or other purpose, such as audio data encoded in an MP3 format or other MPEG audio format, AC-3, DTS, ATRAC, WMA, RealAudio, Ogg Vorbis, APT X100, FLAC, Shorten, Monkey's Audio, or other. Encoding involves modifications to the encoded audio data, such as modifications to coding coefficients and/or to predefined decision thresholds. Processing the audio to read the code is carried out by detecting such modifications using knowledge of predefined audio encoding parameters.

Once the audio data has been processed 120, it is stored 130 for further processing subsequently, for communication from the system and/or for preparation of reports.

It is decided 140 whether further processing 120 is to be carried out. If so, processing parameters are again set 110 and further processing is carried out 120. If not, the data is not further processed. In certain embodiments, the decision whether to process further is carried out by incrementing or decrementing a counter and checking the counter value to determine whether it equals, exceeds or is less than some predetermined value. This is useful where the number of passes is predetermined. In certain embodiments, a flag or other marker is set at 110 when the last parameter value is set and at 140 the flag or marker is tested to determine whether further processing is to be carried out. This is useful where, for example, the number, types or values of the parameters set at 110 can vary.

Figure 2A:
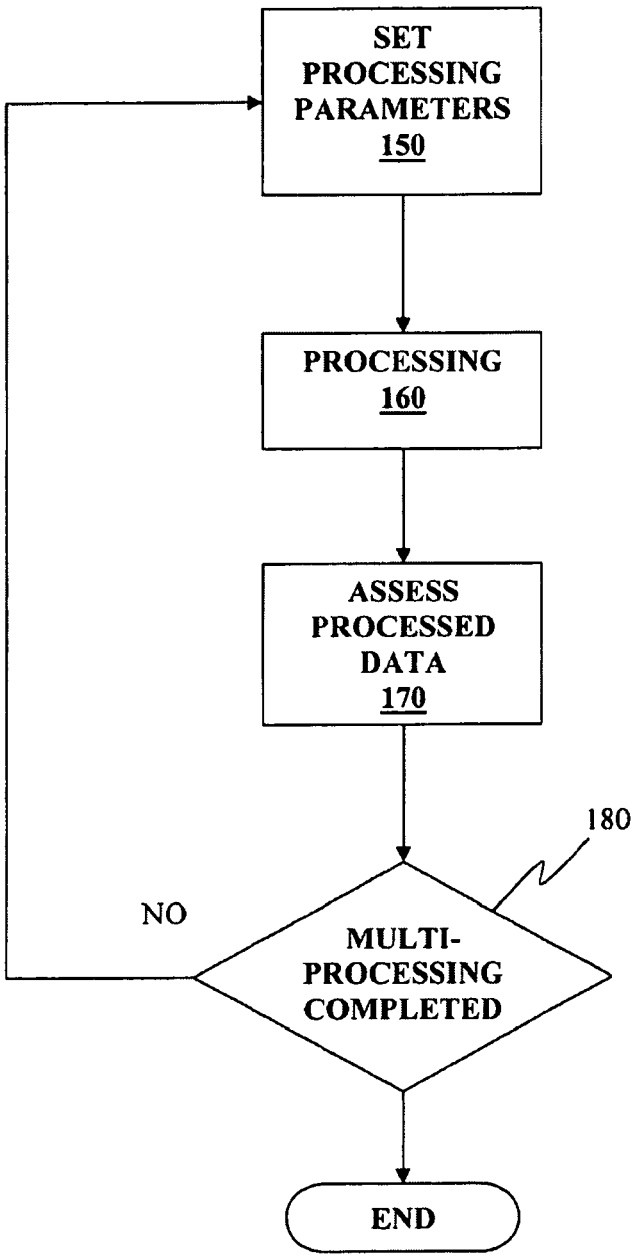
FIG. 2A illustrates an ancillary code reading process of various further embodiments including certain embodiments illustrated in FIG. 1.

In certain embodiments, the data produced at 120 is evaluated to determine if further processing is to be carried out. FIG. 2A is a flow diagram for illustrating such embodiments.

As in the embodiment of FIG. 2, processing parameters are set 150 and processing is carried out 160 to read ancillary codes. Upon completion of processing 160 of the media data by processor 16, the results of such processing are assessed 170. During the assessment 170, the results of the code reading process are evaluated to assess whether the quality or other characteristics of the data produced by processing 160 indicates that further processing using different or modified parameters should be carried out. In certain embodiments where the ancillary codes to be read comprise one or more sequences of symbols representing an encoded message (such as an identification of a station, channel, network, producer or an identification of the content), the assessment comprises determining whether all, some or none of the expected symbols have been read and/or whether a level of quality or merit representing a reliability of symbol detection indicates a sufficient probability of correct detection.

After the processing results are evaluated 170, processor 16 determines 180 whether the stored media data should be processed again. If so, one or more parameters are modified 150 and processor 16 processes 160 the stored media data employing the newly set parameter or parameters. Thereafter, the results of the further processing are assessed 170 and, again, it is determined 180 whether the stored media data should be processed. On the other hand, if the assessment of the processing results indicates decoded signals of sufficient quality or other assessed sufficient characteristic, or if the assessment indicates that it is not worthwhile to process the data again, since the likelihood that an ancillary code is present in the data is not sufficient, the audio media data is not processed further. In certain embodiments, if it is determined that the media data does not have an ancillary code, the media data is discarded or overwritten. In certain embodiments, the media data is processed in a different manner to produce research data, such as by extraction of a signature. In certain embodiments, the media data is stored for further processing by a different system to which it is communicated.

In certain embodiments, if the assessment 170 indicates that some, but not all, of the ancillary code or codes have been read, further processing is carried out. In certain embodiments, if a predetermined number of processing loops have already been carried out and/or a predetermined set of processing parameters has been used, and either all of the ancillary code or codes have not been read or the assessment 170 indicates that better results were not achieved by the most recent processing loop as compared to one or more prior processing loops, processing is discontinued. In certain embodiments, if either a predetermined number of loops have been carried out and/or a predetermined set of processing parameters has been used, and no portion of an ancillary code has been read, processing is discontinued.

A method of gathering data concerning usage of and/or exposure to media data, comprises processing the media data using a parameter having a first value to produce first media usage and/or exposure data, assessing results of the first processing, assigning a second value to the parameter, the second value being different from the first value, and processing the media data using the parameter having the second value based upon the assessed results to produce second media usage and/or exposure data.

A system for gathering data concerning usage of and/or exposure to media data, comprises a processor configured to process the media data using a parameter having a first value to produce first media usage and/or exposure data, to assess results of the first processing, to assign a second value to the parameter, the second value being different from the first value and, based upon the assessed results, to process the media data to produce second media usage and/or exposure data using the parameter having the second value.

A method of gathering data concerning usage of and/or exposure to media data, comprises applying a first window size to the media data to produce first processing data, processing the first processing data to produce first media usage and/or exposure data, applying a second window size to the media data to produce second processing data, the second window size being different from the first window size, and processing the second processing data to produce second media usage and/or exposure data.

A system for gathering data concerning usage of and/or exposure to media data, comprises a processor configured to apply a first window size to the media data to produce first processing data, to process the first processing data to produce first media usage and/or exposure data, to apply a second window size to the media data to produce second processing data, the second window size being different from the first window size, and to process the second processing data to produce second media usage and/or exposure data.

Figure 3:
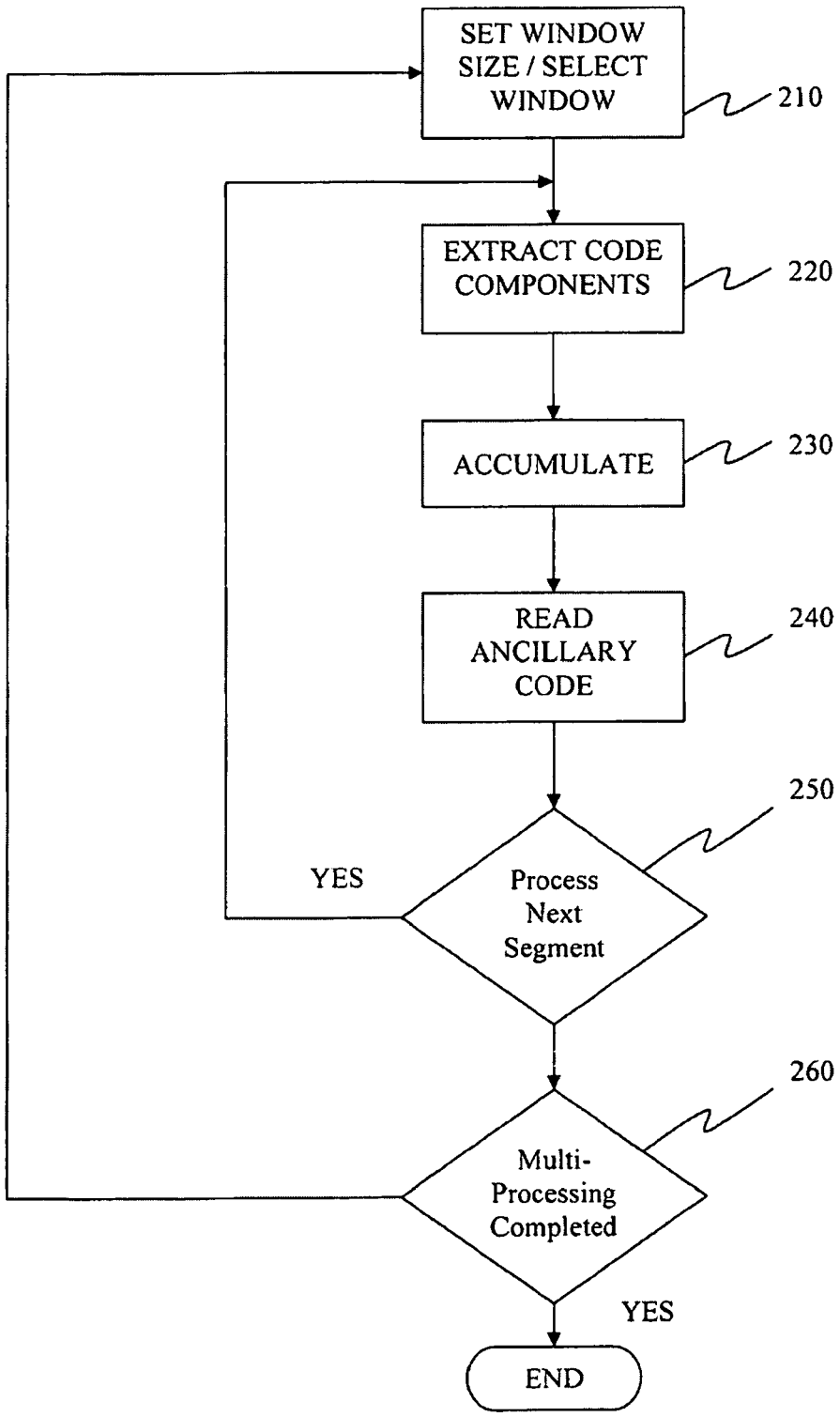
FIG. 3 illustrates an ancillary code reading process in accordance with certain embodiments.

FIG. 3 is a flow diagram 200 illustrating a code reading routine of certain embodiments in which segments of time domain audio data are processed to read a code, if present, therein.

Under real-world conditions, ancillary codes included in audio media data, for example, as a continuing stream of one or more encoded messages, may be difficult to detect in various circumstances. For example, ancillary codes of relatively short duration may be "missed" during decoding if relatively large segments of the audio media containing such data are processed to read the code. This can occur where the ancillary codes form a continuing stream of repeating messages each having the same message length, and the codes are read by accumulating code components repeatedly over the message length. The existence of a relatively short encoded segment may occur as a result of consumer/user switching between different broadcast stations (e.g., television, radio) or other audio and/or video media devices, so that audio media data containing an encoded message is received only for a relatively short duration (e.g., 5 seconds, 10 seconds, etc.). On the other hand, processing smaller segments of audio media data may result in the inability to detect messages encoded throughout relatively large segments of audio media data, especially where data dropouts or noise interfere with reading the codes. Certain embodiments as described herein, and with particular reference to the flowchart 200 of FIG. 3 serve to read ancillary codes included within varying lengths or durations of audio media data.

Initially, as shown in FIG. 3, a segment size parameter (also called "window size" herein) is set 210 to a relatively small size, such as 10 seconds. The audio media data is subjected to one or more processes 220 to extract substantially single-frequency values for the various message symbol components potentially present in the audio data. When the audio media data is received in analog form in the time domain, these processes are advantageously carried out by transforming the analog audio media data to digital audio media data and transforming the latter to frequency domain data having sufficient resolution in the frequency domain to permit separation of the substantially single-frequency components of the potentially-present message symbols. Certain embodiments employ a fast Fourier transform (FFT) to convert the data to the frequency domain and then produce signal-to-noise ratios for the substantially single-frequency symbol components that may be present. In certain ones of such embodiments, an FFT is performed on portions of the time domain audio data having a predetermined length or duration, such as portions representing a fraction of a second (e.g., 0.1 sec., 0.15 sec., 0.25 sec.) of the audio data. Each successive FFT is carried out on a different portion of the audio data which overlaps the last-processed portion, such as an 80%, 60% or 40% overlap. This implementation is disclosed in U.S. Pat. No. 5,764,763 to Jensen et al. which is incorporated by reference herein in its entirety. Other suitable techniques for converting the audio media data into the frequency domain may be utilized, such the use of a different transform or the use of analog or digital filtering.

The frequency components of interest, that is, those frequency components or frequency bins that are expected to contain code components, are accumulated 230 for the entire 10 second window. Techniques for accumulating the code components to facilitate reading the code are disclosed in the above-referenced U.S. Pat. No. 6,871,180 to Neuhauser, et al. and U.S. Pat. No. 6,845,360 to Jensen, et al. Then, the ancillary code, if any, is read 240 from the accumulated frequency components. Techniques for reading accumulated codes are described in the above-referenced U.S. Pat. No. 6,871,180 to Neuhauser, et al., U.S. Pat. No. 6,845,360 to Jensen, et al. and U.S. Pat. No. 6,862,355 to Kolessar, et al.

An ancillary code or codes that have been read, if any, from the audio media data are stored, and the accumulator is reset. In certain embodiments, the next segment, that is, 10 second window, of audio media data is processed in the same manner as previously described for the preceding segment. In certain embodiments, a branching condition is applied 250, to determine whether a further segment of media data is to be processed, depending on whether one or more conditions are satisfied. In certain ones of such embodiments, the condition is whether a predetermined number of audio portions have been processed to read any codes therein. In certain ones of such embodiments, the condition is whether the end of the window has been reached.

Upon the occurrence of such condition, the processor ascertains 260 whether the stored audio media data is to be processed again using a different parameter value. In certain embodiments, the data is processed again using a different window size (e.g., 20 seconds), if a code could not be read using a 10 second window size. Beneficially, codes that are detectable at processed window sizes of 20 seconds, but are not detectable (or much less detectable) if processed at a window size of 10 seconds, are detected during such second pass. In like manner, if a code is not detected after all of the stored media data has been processed at the window size of 20 seconds, in certain embodiments, the window size is set to a longer duration, for example, 30 seconds, and the stored audio media data is processed as before but over the increased window size.

In certain embodiments, the decision 260 is conditioned on the extent, if at all, that ancillary codes were read using a current window size. For example, there can be instances where, due to noise or drop outs, it is not possible to accumulate a sufficient amount of data to permit the symbols of a continuously repeating message to be reliably distinguished, or one or more symbols of the message might be obviously incorrectly detected. In such instances, it may be helpful to accumulate data over a longer interval in order to better distinguish the symbols of a message continuously present in the audio. As a further example, there may be instances where the only ancillary codes apparently present in the audio data are sufficiently short duration messages that can be read effectively using a small window size. In such event and in certain embodiments, it is decided 260 not to process the audio data using a larger window size.

Figure 4:
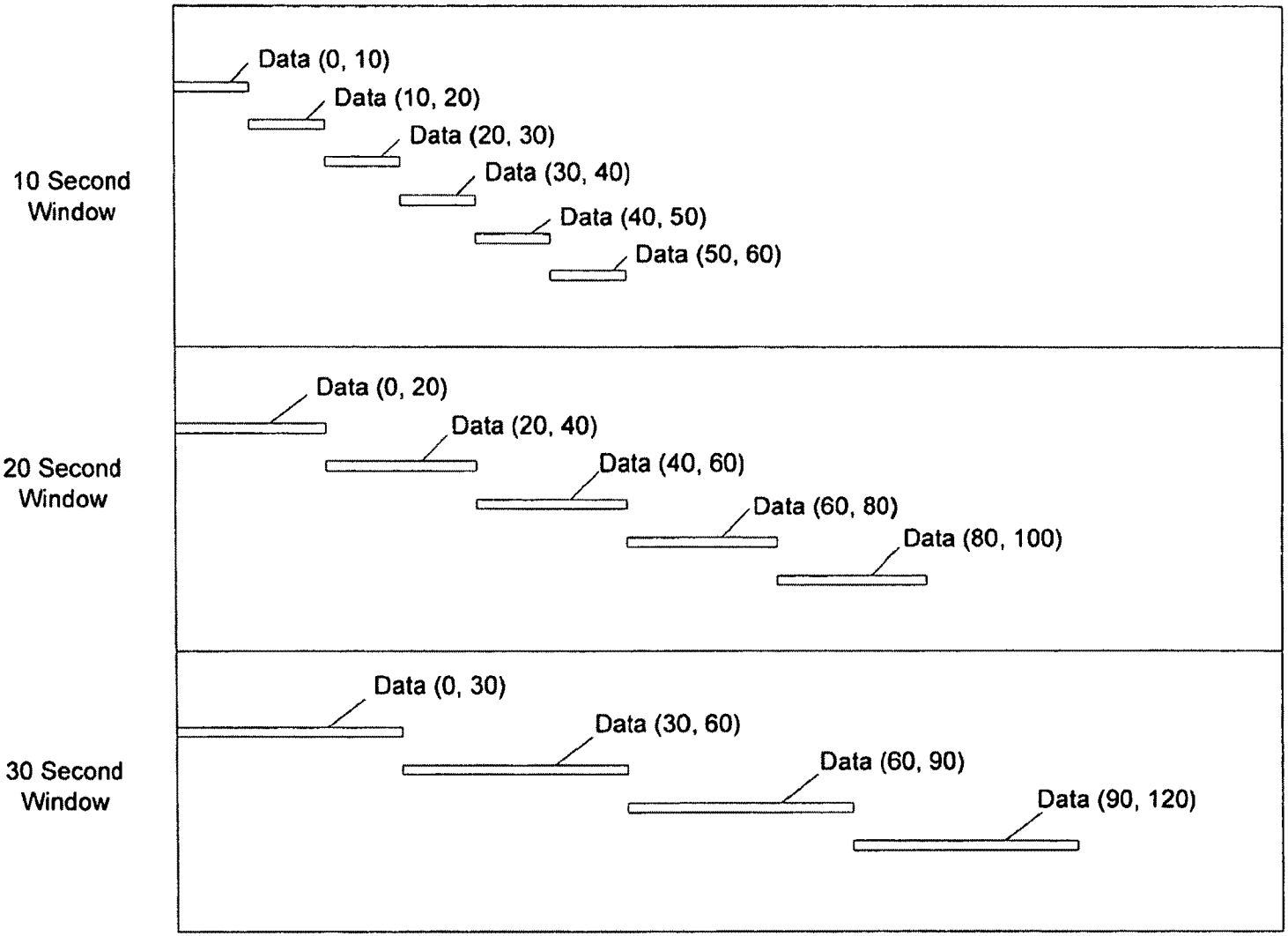
FIG. 4 schematically illustrates certain embodiments for reading ancillary codes from stored media data employing different window sizes.

FIG. 4 schematically illustrates the above-described processing of the stored audio media data in certain embodiments, in which non-overlapping windows of audio data having the same window size are processed. An initial 10 seconds of media data, identified for convenience as Data (0, 10), is processed to read ancillary codes therein. Then, a next subsequent 10 seconds of media data, identified as Data (10, 20) is processed in the same manner for reading any such codes. This process repeats until all of the stored audio media data is processed in such ten second windows.

If the condition or conditions for further processing are met at 250, then the window size is increased to 20 seconds, as previously discussed. Data (0, 20) shown in FIG. 4 is then processed to read any ancillary codes. Thereafter, Data (20, 40) is processed, and so on. FIG. 4 also shows each sample of data processed for a set window size of 30 seconds. For convenience, processing of the stored audio media data at the 10 second window size is referred to herein as "Pass 1" or the initial pass, processing of the stored audio media data at the 20 second window size is referred to herein as "Pass 2" or the second pass, and so on. In certain embodiments, processing of the stored audio media data is limited to a preset maximum number of passes, such as 24 passes wherein the window size during such final pass may be set to 240 seconds. Other maximum number of passes may be set, such as 2, 3, 10, . . . or N.

In certain embodiments, each segment at the set window size of the stored audio media data is processed regardless of whether or not a code is detected. Similarly, in certain embodiments, the entire stored audio media data is processed as described above using windows of multiple sizes regardless of whether ancillary codes have already been detected within the audio media data.

Figure 5:
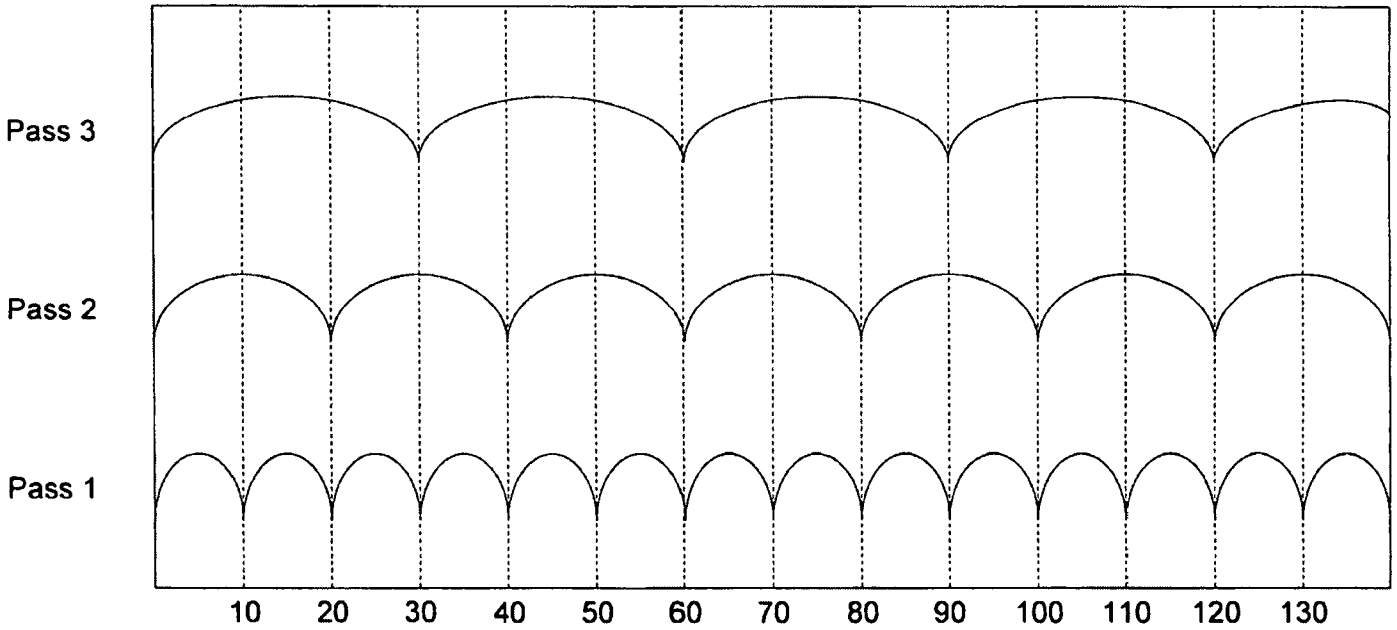
FIG. 5 further schematically illustrates various reading processes employing different window sizes in accordance with certain embodiments.

FIG. 5 is a schematic illustration of multiple processing (i.e., passes) of 140 seconds of stored audio media data. During a first pass (Pass 1), each 10 second segment of stored audio media data is processed, during a second pass (Pass 2), each 20 second segment of stored audio media data is processed, and so. Multiple processing can be limited to, for example, three passes before the results of all of the processing is analyzed to assess the accurate detection of codes contained within the audio media data.

With further reference to FIG. 5, if, for example, codes are contained within the stored audio media data from the time period spanning 60 to 90 seconds (e.g., relative to the start point of the stored audio media data), then those codes will be detected to a high degree of certainty and accuracy during Pass 3. The codes may also be detected during Pass 2, and perhaps even during Pass 1, depending on the length of the codes, the number of times the same code is repeated within that time frame, noise and other factors.

A method of gathering data concerning usage of and/or exposure to media data, comprises processing a first segment of the media data to produce first processed data, reading an ancillary code, if present, based on the first processed data, processing a second segment of the media data to produce second processed data, the second segment of the media data being different from the first segment and including at least a portion of the media data included in the first segment, and reading an ancillary code, if present, based on the second processed data and without the use of the first processed data.

A system for gathering data concerning usage of and/or exposure to media data, comprises a processor configured to process a first segment of the media data to produce first processed data, to read an ancillary code, if present, based on the first processed data, to process a second segment of the media data to produce second processed data, the second segment of the media data being different from the first segment and including at least a portion of the media data included in the first segment, and to read an ancillary code, if present, based on the second processed data and without the use of the first processed data.

Figure 6:
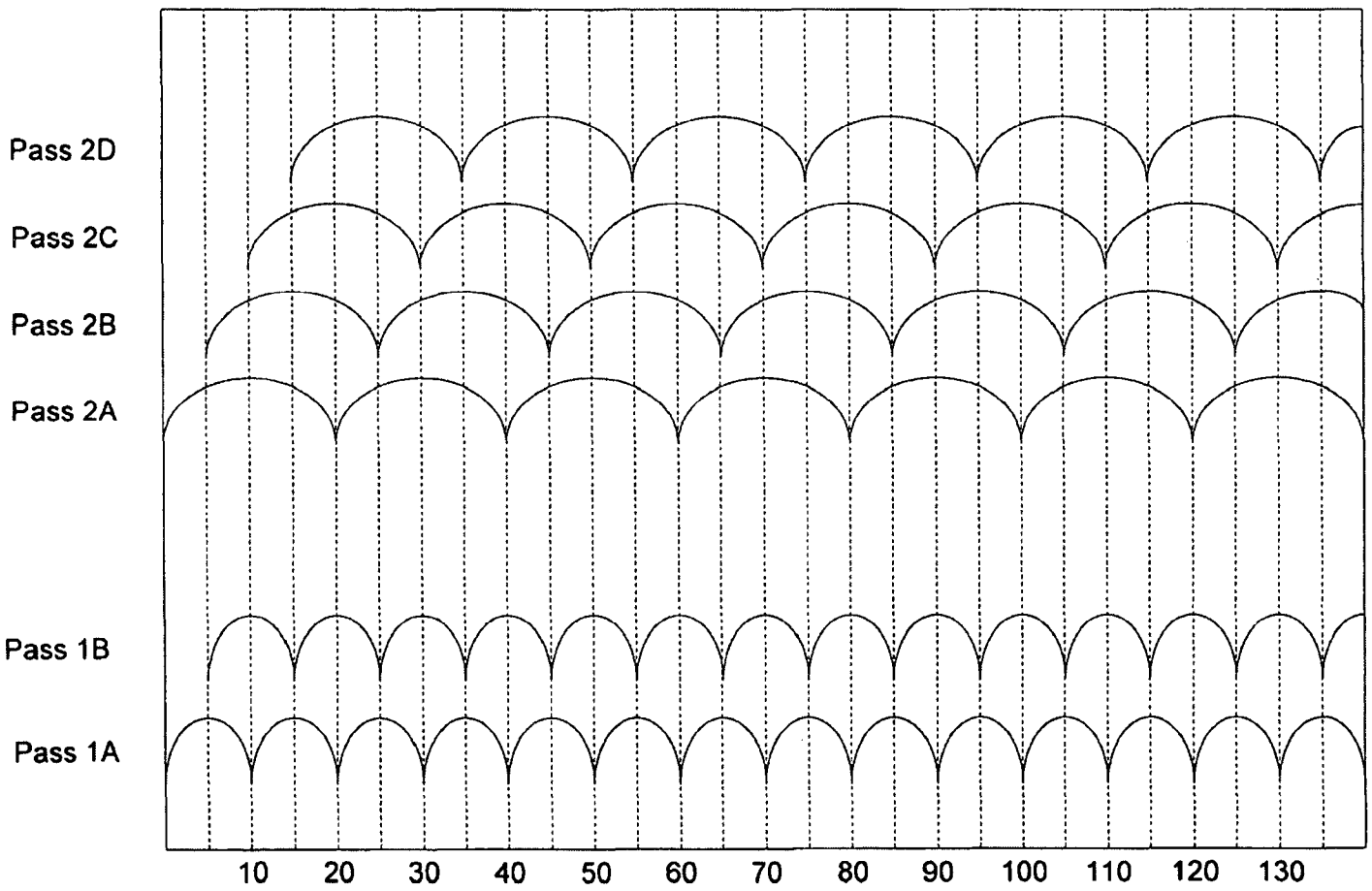
FIG. 6 schematically illustrates the use of multiple sub-passes for reading ancillary codes from stored media data in accordance with certain embodiments.

In certain embodiments, during a subsequent processing of the audio media data, the window size remains the same but the start point of processing of the audio media data is changed. FIG. 6 is a schematic illustration that shows each pass as having multiple "Sub-Passes." It is noted that the terms "Pass" and "Sub-Pass" are used herein for convenience only as a means for distinguishing one processing from another processing. As shown in FIG. 6, the window size is set to 10 seconds for both Pass 1A and Pass 1B, but the start position in the stored audio media data is shifted, or offset, by 5 seconds in Pass 1B relative to the start position in Pass 1A. Passes 2A, 2B, 2C and 2D employ a window size of 20 seconds, with each pass having a start time that is offset by 5 seconds relative to the start time of the previous pass. The amount of the offset may be different than 5 seconds, and the number of subpasses may be the same or different for each window size. In a simplified example, if one or more messages encoded in audio media data are contained within the stored audio media data only within the time period spanning 50 to 70 seconds, then those codes are detected to a relatively high degree of certainty during Pass 2C shown in FIG. 6, although the codes may also be read during other passes, although with a lesser degree of certainty.

In certain embodiments, when processing the media data using a given window size, a succession of overlapping segments are processed in sequence. For example, if the window size is set at 10 seconds in such embodiments, then the first segment is selected as the data from 0 seconds to 10 seconds, the next is selected as the data from (0+x) seconds to (10+x) seconds, the next is selected as the data from (0+2x) seconds to (10+2x) seconds, and so on, where $0<x<10$ seconds.

In certain embodiments discussed herein, various window sizes are indicated, including 10 seconds, 20 seconds, and 30 seconds. In certain embodiments, the window sizes are different and may be smaller or larger. Moreover, in certain embodiments, the increments between different window sizes during subsequent passes (i.e., re-processing of the audio media data) may be a different constant or variable.

In certain embodiments, the start time offset for each segment to be processed may be smaller or larger than that mentioned above. If it is desired to detect the start position or end position of a code within the audio media data to a relatively greater degree, or for another reason, then in certain embodiments the start time offset may be relatively small, such as 1 or 2 seconds.

A method of gathering data concerning usage of and/or exposure to media data comprises processing the media data using a first frequency scale to produce first media usage and/or exposure data, and processing the media data using a second frequency scale to produce second media usage and/or exposure data, the second frequency scale being different from the first frequency scale.

A system for gathering data concerning usage of and/or exposure to media data comprises a processor configured to process the media data using a first frequency scale to produce first media usage and/or exposure data, and to process the media data using a second frequency scale to produce second media usage and/or exposure data, the second frequency scale being different from the first frequency scale.

Figure 7:
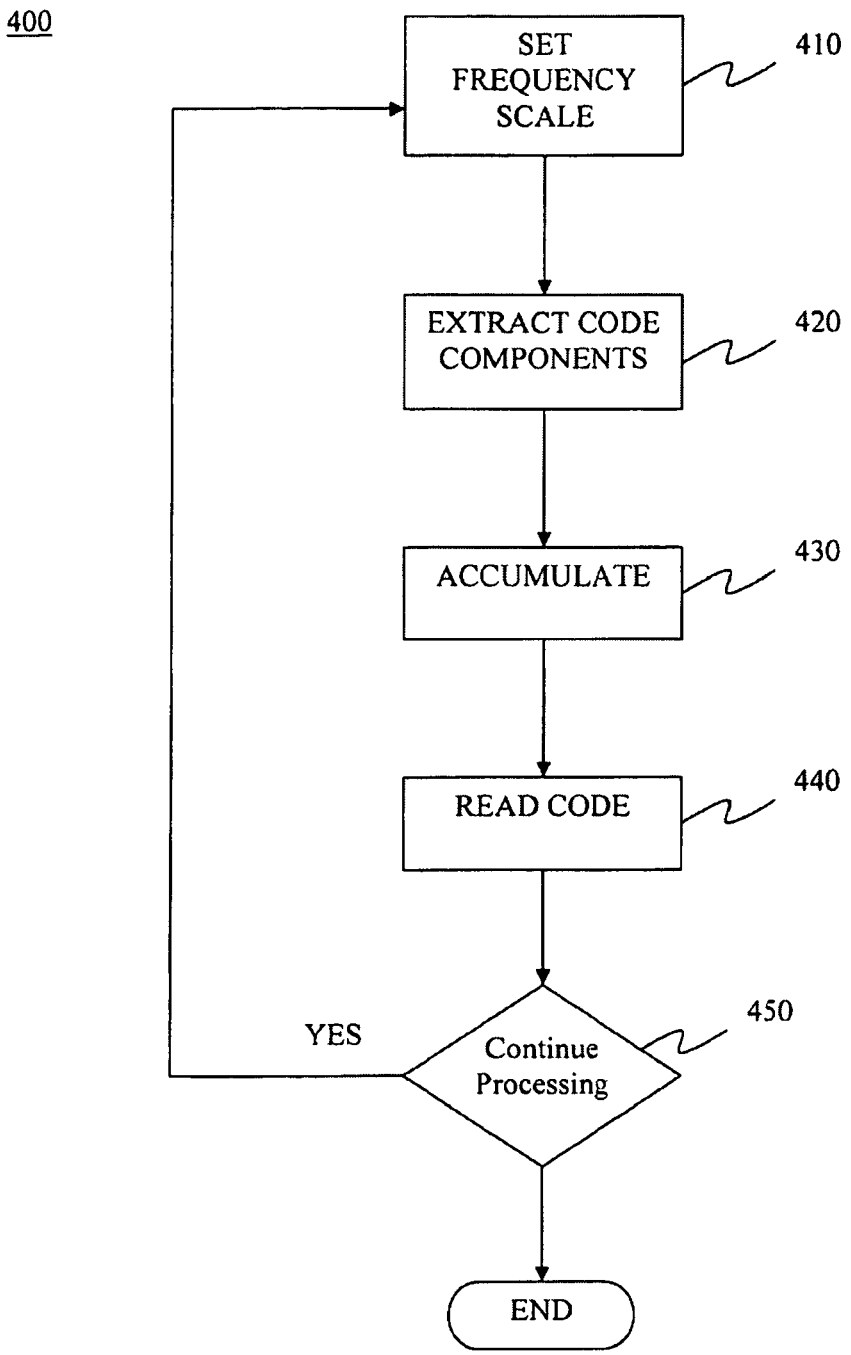
FIG. 7 illustrates various reading processes employing frequency offsets in accordance with certain embodiments.

FIG. 7 is a functional flow diagram 400 used to describe various embodiments for detecting frequency offset codes included within audio media data. In certain embodiments, the process of FIG. 7 is used to read a continuing stream of encoded messages. As previously discussed, in certain embodiments frequency components or frequency bins that are expected to contain code components are accumulated for the sample of audio media data being processed.

Usually, audio playback equipment has a sufficiently accurate clock so that there is negligible frequency offset between the recorded audio and the audio reproduced by the playback equipment. However, if a playback device has an inaccurate clock, a frequency offset will result. In turn, the frequency components that contain code components within the reproduced audio may be sufficiently offset so that they are not detectable if only pre-designated frequencies or frequency bins (i.e., those expected to contain code components) are used. Where a PUA is used to monitor exposure to media data, the same problem can occur if the PUA uses an inaccurate clock. Various embodiments entail processes for detecting frequency shifted code components.

During an initial pass in certain embodiments, a default frequency scale is used 410 (further described below) that assumes the reproducing device or PUA, as the case may be, has an accurate clock. Then, portions of a sample of audio media data stored in storage device 14 are transformed 420, e.g., employing FFT, to the frequency domain, and the frequency domain data is processed in accordance with any suitable symbol sequence reading process, such as any of the processes mentioned herein or the processes described in the references identified above. Frequency components or frequency bins that are expected to contain code components are accumulated 430 for the sample of audio media data being processed (e.g., 10 second window).

The accumulated frequency components are processed 440 to read the code or codes, if any, encoded within the processed sample of audio media data. In certain embodiments, if a code is read 440, then it is assumed that there was either no or only negligible frequency offset, as previously mentioned. At this point, the process terminates 450. In certain embodiments, although a code has been read, data indicating a measure of certainty that the code was read correctly is also produced. Examples of processes for evaluating such a measure of certainty are disclosed in the above-mentioned U.S. Pat. No. 6,862,355 to Kolessar, et al. Such measure of certainty is employed 450 to determine whether to process the media data using a different frequency scale.

If, a code is not detected, or such measure of certainty indicates that the code which was read might be incorrect or was not read sufficiently (for example, if a sufficient number or percentage of symbols were not read) the same sample of audio media data is processed again. In certain embodiments, several passes each using a different frequency scale are carried out before a determination is made whether to cease processing to read an ancillary code from the media data.

During any second pass, a different frequency scale is employed for extracting code components based on the FFT results 420. For example, a frequency scale that assumes a frequency offset of −0.1% is selected 410 so that −0.1% frequency offset code components are accumulated in step 430. The accumulated frequency shifted code components are read 440. If it is then determined to continue processing 450, the sample of audio media data is processed using still another frequency scale. In a third pass, for example, a frequency scale that assumes a frequency offset of +0.1% is selected. If it is again determined to continue processing, a frequency scale that assumes a somewhat greater frequency offset (for example, −0.2%) is employed in a fourth pass. Similarly, if yet still further passes are carried out, frequency scales assuming progressively greater frequency offsets (for example, +0.2%, −0.3%, +0.3%, etc.) are employed. In certain embodiments, other frequency offsets are assumed.

FIG. 8 shows a table identifying ten (10) exemplary frequency bins and their corresponding frequency components in which code components are expected to be included in audio media data containing a code. If the stored audio media data had previously been exposed to, for example, a frequency shift of 0.2%, then the frequency bins and their corresponding frequency components that contain the code components are shown in the table set forth in FIG. 9. If each frequency bin corresponds to, for example, 4 Hz, then a 0.2% offset is sufficient to result in the non-detection of code components within the higher bins during the first few passes described in connection with the flowchart of FIG. 7, but will be detected within one of the passes as herein-described.

In another embodiment, the selected frequency scale (410 in FIG. 7) is based on smaller percentage frequency offsets than those mentioned above. In particular, increments of 0.05% may be employed. Thus, the following Table 1 identifies the frequency offset during each pass for processing a segment of audio media data.

TABLE 1

| Pass | Frequency Offset |
|---|---|
| 1 | 0.00 |
| 2 | −0.05% |
| 3 | +0.05% |
| 4 | −0.1% |
| 5 | +0.1% |
| 6 | −0.15% |
| 7 | +0.15% |

TABLE 1-continued

| Pass | Frequency Offset |
|---|---|
| 8 | −0.20% |
| 9 | +0.20% |
| 10 | −0.25% |
| . | . |
| . | . |
| . | . |

In a further embodiment, the frequency offset employs larger percentage increments than those mentioned herein. For example, increments of 0.5%, 1.0% or another higher increment may be employed.

In yet another embodiment, the frequency offset increases for each pass in the same direction (e.g., positive, negative) until a set maximum offset, for example, 1.0%, is reached at which point frequency offset is set in the other direction, such as shown below in Table 2. In yet another embodiment, different increments may be employed.

TABLE 2

| Pass | Frequency Offset |
|---|---|
| 1 | 0.00 |
| 2 | +0.05% |
| 3 | +0.10% |
| 4 | +0.15% |
| 5 | +0.20% |
| 6 | +0.25% |
| . | . |
| . | . |
| . | . |
| 21 | +1.00% |
| 22 | −0.05% |
| 23 | 0.10% |
| 24 | −0.15% |
| 25 | 0.20% |
| 26 | −0.25% |
| . | . |
| . | . |
| . | . |
| 41 | −1.00% |

In the various embodiments described herein, a code encoded within audio media data and its detection as herein described may also refer to a symbol or a portion of a code. In general, a message included in audio media data usually comprises a plurality of message symbols. The audio media data may also include plural messages. From the stream of messages, a symbol sequence is examined to detect the presence of a message in a predetermined format. The symbol sequence may be selected for examination in any of a number of different ways such as disclosed in U.S. Pat. No. 6,862,355 to Kolessar et al. and in U.S. Pat. No. 6,845,360 to Jensen, et al. For example, a group of sequential symbols may be examined based on the length or duration of the data. As another example, prior detection of a sequence of symbols may be used to detect subsequent sequences. As a further example, the use of a synchronization symbol may be used.

Since the message has a predetermined format, processor 16 in detecting each message within the audio media data stored within storage 14 in certain embodiments relies upon both the detection of some symbols and the message format to determine whether a message has been detected. U.S. Pat. No. 6,862,355 to Kolessar et al., mentioned above, sets forth various techniques for reconstructing a message if only partial detection of that message is possible.

Figure 10:
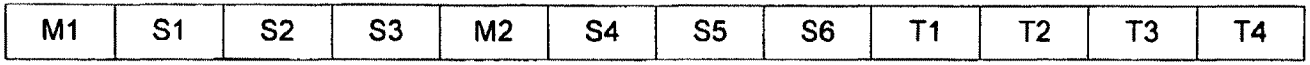
FIG. 10 shows an exemplary pattern of symbols comprising a message.

In certain embodiments, audio media data is stored within storage 14 shown in FIG. 1 and processed to detect a message having a predetermined symbol format, such as shown in FIG. 10. In the exemplary format shown in FIG. 10, the message is comprised of 12 symbols, with symbols M1 and M2 representing marker symbols, symbols S1, S2, S3, S4, S5 and S6 representing various code symbols, and symbols T1, T2, T3 and T4 representing time symbols. If less than all of the symbols of a single message are detected during processing, then previously detected messages and/or subsequently detected messages are analyzed to identify, if possible, the values of the symbols not detected, also called herein for convenience, the "missing symbols." In certain embodiments, during processing of the audio media data, the accumulator is cleared or reset after a period of time.

Figure 11:
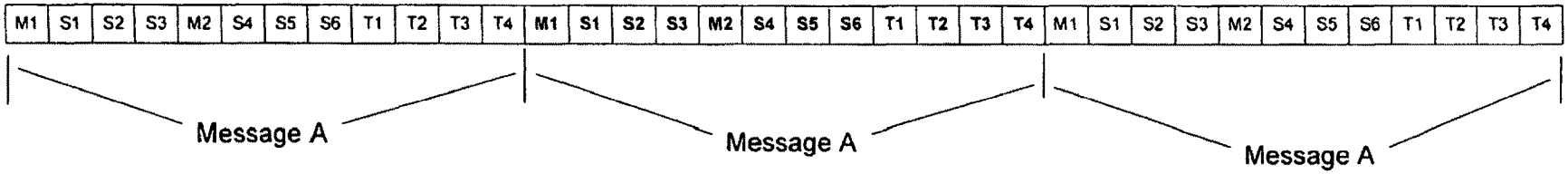
FIG. 11 is an exemplary pattern of symbols encoded within audio media data representing the same message "A" repeated three times.
Figure 12:
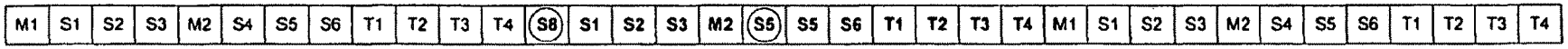
FIG. 12 shows an exemplary pattern of decoded symbols containing incorrectly decoded symbols.

FIG. 11 is an exemplary pattern of symbols encoded within audio media data representing the same message "A" repeated three times. Prior to decoding of each message, that is, each occurrence of message A, the accumulator is cleared. For various reasons, including dropouts and noise, all of the symbols may not be detected during initial processing. FIG. 12 shows an exemplary pattern of the decoded symbols wherein the circled symbols are incorrectly decoded and thus represent "missing symbols." In accordance with certain embodiments, since it is known that a message is repeated in accordance with a known format, the audio media data containing the missing symbols is compared to previously and/or subsequently decoded messages. As a result of the comparison and processing, circled symbol S8 is deemed to actually be marker symbol "M1." Similarly, circled symbol S5 is deemed to actually be data symbol "S4."

In accordance with certain embodiments, messages identified to contain missing symbols are processed in any of the various manners herein described to decode, if possible, the correct symbols. For example, the stored audio media data processed to contain such missing symbols is reprocessed in accordance with one or more processes described herein with reference to FIG. 5 and/or FIG. 6.

FIG. 1, as previously discussed, discloses a system 10 containing at least storage 14 and processor 16. In certain embodiments, system 10 comprises a portable monitoring device that can be carried by a panelist to monitor media from various sources as the panelist moves about. In certain embodiments, processor 16 carries out the processing of the audio media data stored in storage 14. Such processing includes the processing as described in the various embodiments described herein.

A method of gathering data concerning usage of and/or exposure to media data using a portable monitor carried on the person of a panelist comprises storing audio media data in the portable monitor and disabling a capability of the portable monitor to carry out at least one process necessary for producing usage and/or exposure data from the audio media data while the portable monitor is powered by a power source on board the portable monitor, and while the portable monitor is powered by a power source external to the portable monitor, carrying out the at least one process with the use of the portable monitor for producing the usage and/or exposure data.

A portable monitor for use in producing data concerning usage of and/or exposure of a panelist to media data while the monitor is carried on the person of the panelist, comprises an on-board power source, a storage for storing audio media data while the portable monitor is powered by the on-board power source, and a processor configured to carry out at least one process necessary for producing usage and/or exposure data from the audio media data when the portable monitor is powered by an external power source, but to refrain from carrying out the at least one process while the portable monitor is not receiving power from the external power source.

Figure 13:
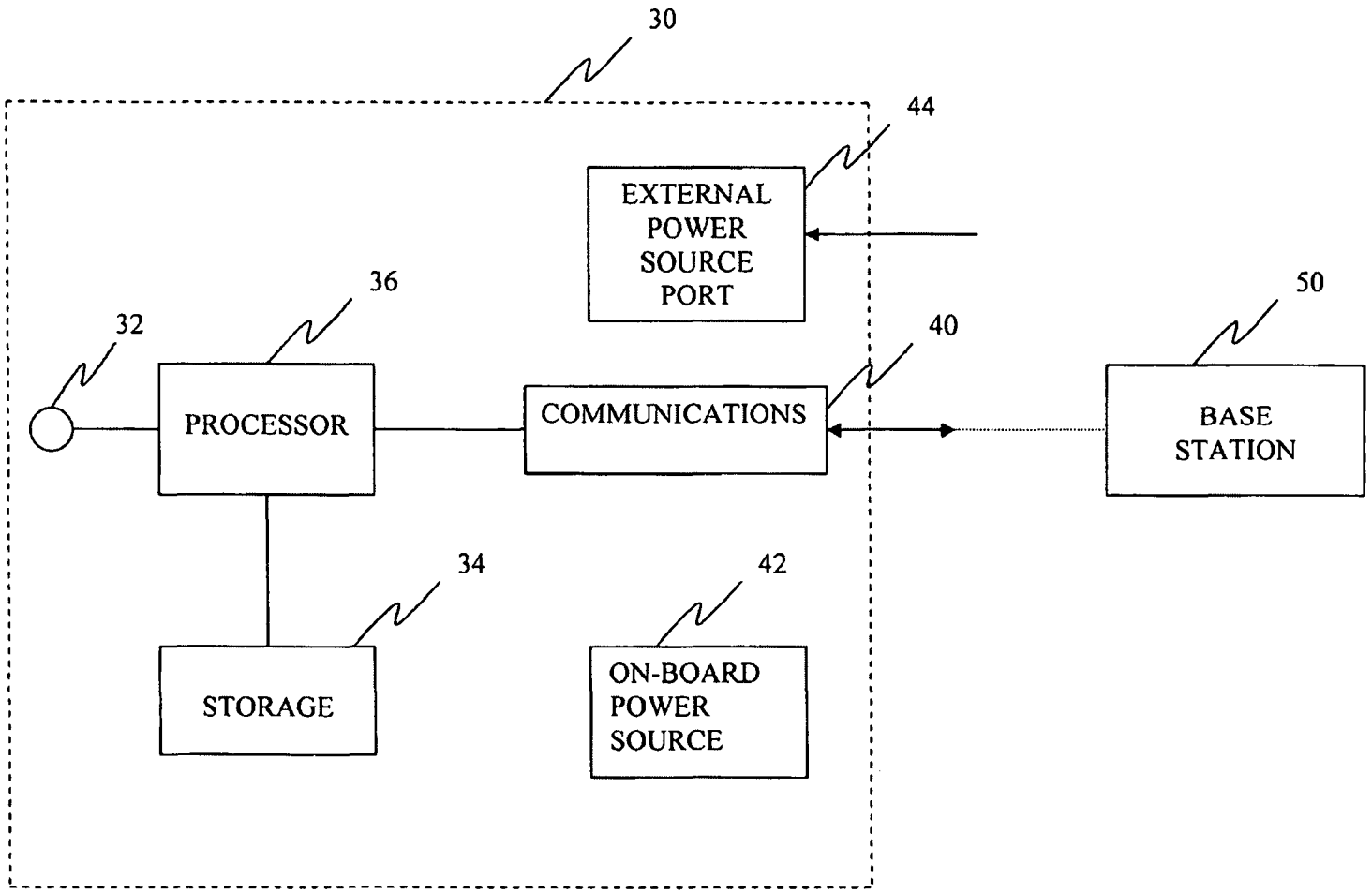
FIG. 13 is a functional block diagram illustrating a system operating in multiple power modes in accordance with certain embodiments.

FIG. 13 is a functional block diagram illustrating a system 30 in certain embodiments in which different types of processing are carried out based upon the types and/or sources of power powering the various components of system 30. As shown, system 30 is similar to system 10 shown in FIG. 1 and includes an audio media data input 32, storage device 34, processor 36, and data transfer device 40. The functions and variations of these devices within system 30 may be the same or similar to those of the devices within system 10, and thus descriptions of such functions and variations are not repeated herein.

System 30 also includes an internal power source 42, generally in the form of a rechargeable battery or other on-board power source suitable for use within a portable device. Examples of other suitable on-board power sources include, but are not limited to, a non-rechargeable battery, a capacitor, and an on-board power generator (e.g., a solar photovoltaic panel, mechanical to electrical power converter, etc.).

On-board power source 42 provides a source of power to each of the devices within system 30. System 30 further includes a device 44 (called "external power source port" in FIG. 13) for enabling each of the devices within system 30 to be powered via an external electrical power source. In certain embodiments, device 44 and data transfer device 40 serve to obtain external power and transfer data, respectively, when system 30 is physically coupled to a base station 50 or other appropriate equipment.

In accordance with certain embodiments, a panelist carries system 30 in the form of a portable monitoring device (also called herein "portable monitor 30") on his/her person. When the person is exposed to acoustic audio media data, this is also received at input 32 of portable monitor 30 which records the audio media data within storage 34. The audio media data received by input 32 may be processed by processor 36 in ways that require relatively low power as supplied by internal power source 42 (sometimes referred to herein, for convenience, as operation in "low power mode" or "on-board power mode"). Such processing may include noise filtering, compression and other known processes which collectively require substantially less power than that required for processor 36 to process the audio media data stored in storage 34 to read ancillary codes therefrom, such transformation of the audio media data to the frequency domain. Thus, the data stored in storage 34 comprises the audio media data received by input 32 and/or partially processed audio media data.

According to a further embodiment of the invention, data corresponding to a received signal is stored in a memory device. According to one embodiment of the invention, the received signal is stored in a raw data format. In another embodiment of the invention the received data signal is stored in a processed data format such as, for example, a compressed data format. In various embodiments of the invention, stored data is subsequently transferred to an external processing system for extraction of information such as ancillary codes.

According to one embodiment of the invention, a time interval is allowed to elapse between storage of the data in the memory device and subsequent transfer the data for processing. In still another embodiment of the invention, processing the data take place without transfer to an external processing system, but after the time interval has elapsed, and at a time when a supplemental power supply is available. In one embodiment of the invention, processing that occurs after the time interval has elapsed is relatively slow processing, as compared with real-time processing.

From time to time, or periodically, the panelist couples the portable monitor 30 with the base station 50 which then serves as an external source of power thereto. The base station may be, for example, of a kind disclosed in U.S. Pat. No. 5,483,276 to Brooks, et al., which is hereby incorporated herein by reference in its entirety. In certain embodiments, the panelist couples a suitable external power cable to external power source port 44 to provide an external source of power to portable monitor 30.

When an external source of power is applied to portable monitor 30, this is detected by processor 30, which then or thereafter switches to a high power mode or external power mode. In such high power mode or external power mode, processor 30 carries out processes in addition to those it carries out when operating in the low power mode or on-board power mode. In certain embodiments, such processes comprise those required to read an ancillary code from the stored media data or to complete processing of partially processed data to read such ancillary code.

In certain embodiments, processor 36 operating in the high power mode or external power mode processes the audio media data stored in storage 34 and/or the partially processed data stored therein, in multiple code-reading processes, each using one or more parameters differing from one or more parameters used in others of such multiple code reading processes. Various embodiments of such code reading processes are disclosed hereinabove.

In certain embodiments, processor 36 operating in the high power mode or external power mode further processes ancillary codes read by processor 16 operating in the low power mode or on-board power mode, to confirm that the previously read ancillary codes were read correctly or to apply processes to read or infer portions of the ancillary code that previously were not read. In certain ones of such embodiments, where fewer than all symbols of an ancillary code were read or read correctly by processor 16 in the low power mode or on-board power mode, processor 16 operating in the high power mode or external power mode identifies the message symbols not read or read incorrectly based on corresponding message symbols read in previous or subsequent messages read from the media data. Such processing in the high power mode or external power mode is carried out in certain embodiments in the manner as explained hereinabove in connection with FIGS. 10, 11 and 12 hereof.

Figure 14:
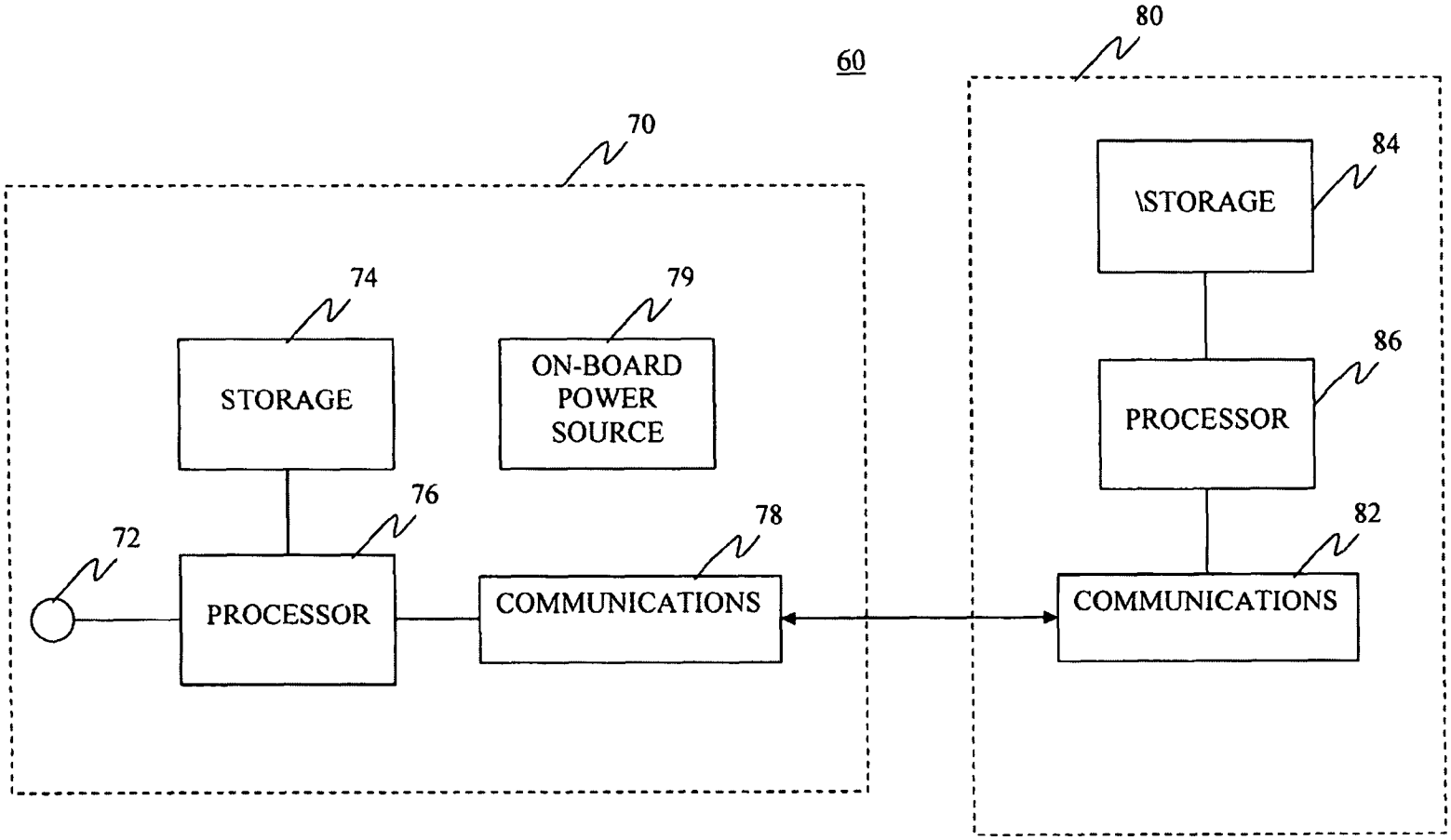
FIG. 14 is another functional block diagram illustrating a system operating in multiple modes in accordance with certain further embodiments.

FIG. 14 is a functional block diagram illustrating a system 60 of certain embodiments in which audio media data is stored within a first, portable monitor carried on the person of a panelist and the stored audio media data is processed by a second device within the panelist's household to detect codes contained within the audio media data. As shown in FIG. 14, system 60 includes a portable monitor 70 that includes an input 72, storage 74, a processor 76, a data transfer device 78 and an internal power source 79. Each of these components within portable monitor 70 operates in a manner similar to those in portable monitor 30 previously discussed. During operation, the panelist carries portable monitor 70 on his/her person as portable monitor 70 stores within storage 74 audio media data to which the panelist has been exposed. Processor 76 may carry out minimal processing of the received audio media data, such as filtering, compression or some, but not all, of the processing required to read any ancillary codes in such data.

From time to time, or periodically, portable monitor 70 is coupled, wirelessly or via a wired connection, to system 80 which includes a data transfer device 82, storage 84 and a processor 86. In certain embodiments, system 80 is a base station, hub or other device located in the household of the panelist.

Audio media data stored in storage 74 of portable monitor 70 is transferred to system 80 via their respective data transfer devices 72 and 82 and the transferred audio media data is stored in storage 84 for further processing by processor 86. Processor 86 then carries out the various processes as herein disclosed to detect the codes contained within the audio media data. In certain embodiments, processor 86 carries out a single code reading process on the audio media data. In certain embodiments, processor 86 carries out multiple code reading processes, each time varying one or more parameters, as disclosed hereinabove.

In certain embodiments, processor 86 further processes ancillary codes read by processor 76 to confirm that such ancillary codes were read correctly or to apply processes to read or infer portions of the ancillary codes that were not read by processor 76. In certain ones of such embodiments, where fewer than all symbols of an ancillary code were read or read correctly by processor 76, processor 86 identifies the message symbols not read or read incorrectly based on corresponding message symbols read in previous or subsequent messages read from the media data. Such processing by processor 86 is carried out in certain embodiments in the manner as explained hereinabove in connection with FIGS. 10, 11 and 12 hereof.

Certain embodiments described above pertain to various systems that gather audio media data in a portable monitor when operating in a low power mode, that is, when the source of power is an on-board power supply, and that process the gathered data in one form or another in the portable monitor when it is operating in a high power mode, that is, when the source of power is an externally supplied source of electrical power.

A method of operating a portable research data gathering device comprises sensing at a first time that power for operating the portable research data gathering device is provided from a power source on-board the portable research data gathering device, operating the portable research data gathering device in a low power consumption mode after such first time, sensing at a second time different from the first time that electrical power for operating the portable research data gathering device is provided from an external power source, and operating the portable research data gathering device in a high power consumption mode after such second time.

A portable research data gathering device comprises a detector adapted to sense at a first time that power for operating the portable research data gathering device is provided from a power source on-board the portable research data gathering device, and adapted to sense at a second time different from the first time that electrical power for operating the portable research data gathering device is provided from an external power source; and a processor adapted to operate in a low power consumption mode after said first time, and adapted to operate in a high power consumption mode after said second time.

In certain embodiments, data is gathered and stored in the low power mode and the stored data is processed in the high power mode. In certain embodiments, processing of the data entails reading a code within the stored data.

In various embodiments described herein, different processes are carried out depending on the source of the power being utilized to power the processing of the stored audio media data. Due to currently existing power limitations (e.g., limitations of existing portable power sources), time limitations or other factors, certain embodiments beneficially enable the extensive processing of media data in various ways.

Although various embodiments of the present invention have been described with reference to a particular arrangement of parts, features and the like, these are not intended to exhaust all possible arrangements or features, and indeed many other embodiments, modifications and variations will be ascertainable to those of skill in the art.

What is claimed is:

1. An apparatus to recover a code from media, the apparatus comprising:

memory including computer readable instructions; and a processor to execute the instructions to at least:

detect whether the apparatus is powered by an internal power source or an external power source;

in response to detecting the apparatus is powered by the internal power source, perform first processing on a received audio signal to determine audio data to store in storage of the apparatus; and in response to detecting the apparatus is powered by the external power source, perform second processing on the stored audio data to recover the code, the second processing different from the first processing.

2. The apparatus of claim 1, wherein the first processing includes at least one of noise filtering or compression, and the second processing includes a frequency transformation.

3. The apparatus of claim 1, wherein the processor is to wait to perform the second processing until the apparatus is powered by the external power source and a time period has expired since the audio data was stored in the storage of the apparatus.

4. The apparatus of claim 1, wherein to perform the second processing, the processor is to perform multiple code reading processes on the stored audio data to recover the code, the processor to use different process parameters in respective ones of the multiple code reading processes.

5. The apparatus of claim 1, wherein to perform the second processing, the processor is to:

process the stored audio data based on a first frequency offset;

determine that the code is not recoverable from the stored audio data using a first group of frequency components of the audio data determined based on the first frequency offset;

successively process the stored audio data based on a predetermined pattern of positive and negative frequency offsets to determine a second frequency offset corresponding to a different second group of frequency components of the stored audio data to be used to recover the code; and recover the code from the stored audio data using the different second group of frequency components of the stored audio data corresponding to the second frequency offset.

6. The apparatus of claim 1, wherein to perform the second processing, the processor is to:

perform up to a first number of first passes through the stored audio data based on a first window of time to determine whether the code is recoverable from the stored audio data using the first window of time, respective ones of the first passes to process samples of the stored audio data corresponding to the same first window of time, the samples for a first one of the first passes to be offset relative to the samples for a second one of the first passes; and in response to a determination that the code is not recoverable from the stored audio data using the first window of time, perform up to a second number of second passes through the stored audio data based on a second window of time larger than the first window of time to recover the code from the stored audio data, respective ones of the second passes to process samples of the stored audio data corresponding to the same second window of time, the samples for a first one of the second passes to be offset relative to the samples for a second one of the second passes.

7. The apparatus of claim 1, further including a microphone to obtain the received audio signal.

8. An article of manufacture comprising computer readable instructions that, when executed, cause a processor of a device to at least:

detect whether the device is powered by an internal power source or an external power source;

in response to detecting the device is powered by the internal power source, perform first processing on a received audio signal to determine audio data to store in storage of the device; and in response to detecting the device is powered by the external power source, perform second processing on the stored audio data to recover the code, the second processing different from the first processing.

9. The article of manufacture of claim 8, wherein the first processing includes at least one of noise filtering or compression, and the second processing includes a frequency transformation.

10. The article of manufacture of claim 8, wherein the instructions, when executed, cause the processor to wait to perform the second processing until the device is powered by the external power source and a time period has expired since the audio data was stored in the storage of the device.

11. The article of manufacture of claim 8, wherein to perform the second processing the instructions, when executed, cause the processor to perform multiple code reading processes on the stored audio data to recover the code, the processor to use different process parameters in respective ones of the multiple code reading processes.

12. The article of manufacture of claim 8, wherein to perform the second processing the instructions, when executed, cause the processor to:

process the stored audio data based on a first frequency offset;

determine that the code is not recoverable from the stored audio data using a first group of frequency components of the audio data determined based on the first frequency offset;

successively process the stored audio data based on a predetermined pattern of positive and negative frequency offsets to determine a second frequency offset corresponding to a different second group of frequency components of the stored audio data to be used to recover the code; and recover the code from the stored audio data using the different second group of frequency components of the stored audio data corresponding to the second frequency offset.

13. The article of manufacture of claim 8, wherein to perform the second processing the instructions, when executed, cause the processor to:

perform up to a first number of first passes through the stored audio data based on a first window of time to determine whether the code is recoverable from the stored audio data using the first window of time, respective ones of the first passes to process samples of the stored audio data corresponding to the same first window of time, the samples for a first one of the first passes to be offset relative to the samples for a second one of the first passes; and in response to a determination that the code is not recoverable from the stored audio data using the first window of time, perform up to a second number of second passes through the stored audio data based on a second window of time larger than the first window of time to recover the code from the stored audio data, respective ones of the second passes to process samples of the stored audio data corresponding to the same second window of time, the samples for a first one of the second passes to be offset relative to the samples for a second one of the second passes.

14. A method to recover a code from media, the method comprising:

detecting whether a device is powered by an internal power source or an external power source;

in response to detecting the device is powered by the internal power source, performing, by executing an instruction with a processor, first processing on a received audio signal to determine audio data to store in storage of the device; and in response to detecting the device is powered by the external power source, performing, by executing an instruction with the processor, second processing on the stored audio data to recover the code, the second processing different from the first processing.

15. The method of claim 14, wherein the first processing includes at least one of noise filtering or compression, and the second processing includes a frequency transformation.

16. The method of claim 14, further including waiting to perform the second processing until the device is powered by the external power source and a time period has expired since the audio data was stored in the storage of the device.

17. The method of claim 14, wherein the performing of the second processing includes performing multiple code reading processes on the stored audio data to recover the code, the processor to use different process parameters in respective ones of the multiple code reading processes.

18. The method of claim 14, wherein the performing of the second processing includes:

processing the stored audio data based on a first frequency offset;

determining that the code is not recoverable from the stored audio data using a first group of frequency components of the audio data determined based on the first frequency offset;

successively processing the stored audio data based on a predetermined pattern of positive and negative frequency offsets to determine a second frequency offset corresponding to a different second group of frequency components of the stored audio data to be used to recover the code; and recovering the code from the stored audio data using the different second group of frequency components of the stored audio data corresponding to the second frequency offset.

19. The method of claim 14, wherein the performing of the second processing includes:

performing up to a first number of first passes through the stored audio data based on a first window of time to determine whether the code is recoverable from the stored audio data using the first window of time, respective ones of the first passes to process samples of the stored audio data corresponding to the same first window of time, the samples for a first one of the first passes to be offset relative to the samples for a second one of the first passes; and in response to a determination that the code is not recoverable from the stored audio data using the first window of time, performing up to a second number of second passes through the stored audio data based on a second window of time larger than the first window of time to recover the code from the stored audio data, respective ones of the second passes to process samples of the stored audio data corresponding to the same second window of time, the samples for a first one of the second passes to be offset relative to the samples for a second one of the second passes.

20. The method of claim 14, further including obtaining the received audio signal with a microphone of the device.

* * * * *